11/20/84 XR 4,483,397

United States Patent [19]

Gray

[11] Patent Number: 4,483,397

[45] Date of Patent: Nov. 20, 1984

[54] METHOD AND APPARATUS FOR MONITORING WELL TUBING FLUID

[75] Inventor: William R. Gray, Huntsville, Tex.

[73] Assignee: Hughes Tool Company, Houston, Tex.

[21] Appl. No.: 453,050

[22] Filed: Dec. 27, 1982

[51] Int. Cl.[3] ..... E21B 47/00

[52] U.S. Cl. ..... 166/250; 166/117.5; 73/151

[58] Field of Search ..... 166/244 C, 250, 117.5, 166/113; 73/86, 151, 155, 432 B

[56] References Cited

U.S. PATENT DOCUMENTS

| | | | |
|---|---|---|---|
| 3,665,955 | 5/1972 | Conner, Sr. | 166/117.5 X |
| 3,828,853 | 8/1974 | Neal | 166/117.5 |
| 3,965,979 | 6/1976 | Lamb | 166/117.5 |
| 4,105,279 | 8/1978 | Glotin | 166/117.5 X |

FOREIGN PATENT DOCUMENTS

| | | | |
|---|---|---|---|
| 381972 | 8/1973 | U.S.S.R. | 73/86 |

OTHER PUBLICATIONS p. 10, *Downhole Corrosion Coupon Holders, Bottom-Hole Sampler,* Cosasco Catalog.

*Primary Examiner*—George A. Suchfield
*Assistant Examiner*—Bruce M. Kisliuk
*Attorney, Agent, or Firm*—Robert A. Felsman; James E. Bradley

[57] ABSTRACT

A method and an apparatus for monitoring tubing fluid downhole in an oil or gas well. A side pocket mandrel is installed in the well tubing string at a depth at which monitoring is desired. The outer surface of the mandrel is free of apertures. Coupons of a selected material are mounted in a carrier, which is placed in the side pocket of the mandrel. Ports and passages allow tubing fluid to communicate with the coupons. The carrier is then removed from the well and the coupons are inspected.

6 Claims, 6 Drawing Figures

METHOD AND APPARATUS FOR MONITORING WELL TUBING FLUID

BACKGROUND OF THE INVENTION

1. Field of the Invention

This invention relates in general to methods and devices for monitoring fluids in a producing well, and in particular to methods and devices for monitoring well tubing fluid by installing a monitoring device downhole in a side pocket mandrel.

2. Description of the Prior Art

Wells such as those used for the production of oil or gas normally contain several concentric metal conduits extending from the bottom of the well to the surface. The inner conduits are known as well tubing and the outermost conduit is known as the well casing. Various fluids flow or are pumped upwardly or downwardly within the innermost tubing or within the annular spaces between conduits.

Tubing fluid, the fluid within the tubing, may be highly corrosive to the steel tubing. Carbon dioxide and hydrogen sulfide are common corrosives in many oil gas wells. Tubing failure because of corrosion necessitates extensive workover. In order to combat corrosion, various chemicals are injected into the well or into the producing formation. These chemicals inhibit the corrosive action of the well fluids on the steel tubing.

The injection of corrosion inhibitor into a well has at times been unsuccessful because of the failure of the solution to completely coat the metal to be protected. U.S. Pat. No. 3,385,358 (Shell) shows a monitoring device used to inspect for total coverage. A tracer material is included in the inhibitor solution prior to injection. Then, after injection, a radioactivity detector is lowered into the well on a wireline to monitor the coverage of the inhibitor solution.

Another method of monitoring the effects of corrosion inhibitor is to insert metal coupons into the fluid for a specified time and then inspect the coupons. One method and apparatus for inserting coupons into a surface pipeline is described in U.S. Pat. No. 4,275,592 (Atwood). This method is excellent for monitoring fluid in a surface pipeline, but the corrosive effects of the fluid in the surface pipeline may be different from the corrosive effects of fluid downhole.

Corrosion monitoring coupons have been placed downhole in devices which are lowered down the string of tubing. The device partially blocks the flow of fluid through the tubing, and the device must be removed before other tools can be run down the tubing.

SUMMARY OF THE INVENTION

The general object of the invention is to provide a method and an apparatus for monitoring tubing fluid in a well at points downhole, such as near the point at which a corrosion inhibiting solution is injected into the producing formation or into the well tubing or casing.

In general this object is accomplished by installing a well tubing mandrel into the well tubing at the point downhole at which monitoring is desired. The mandrel has a main bore and a side pocket offset from the main bore. This type of mandrel is thus known as a side pocket mandrel. The mandrel has several passages between the main bore and the side pocket, but the exterior surface of the mandrel is free of apertures.

Corrosion monitoring coupons are then mounted in a cylindrical coupon carrier. The coupon are rods of a selected material, usually the same type steel as the tubing. The coupon carrier is then run down the tubing and inserted into the side pocket of the mandrel using a conventional kickover tool and other related tools. The carrier is detached from the kickover tool and the tool is removed from the well. For a specified time the carrier is left in the side pocket with the coupons in communication with the tubing fluid. At the end of the test period, the kickover tool is used to retrieve the carrier and remove it from the well. The coupon can then be inspected to determine the effectiveness of the corrosion inhibitor.

The above as well as additional objects, features and advantages of the invention will become apparent in the following detailed description.

DESCRIPTION OF THE PREFERRED EMBODIMENT

Figure 1:
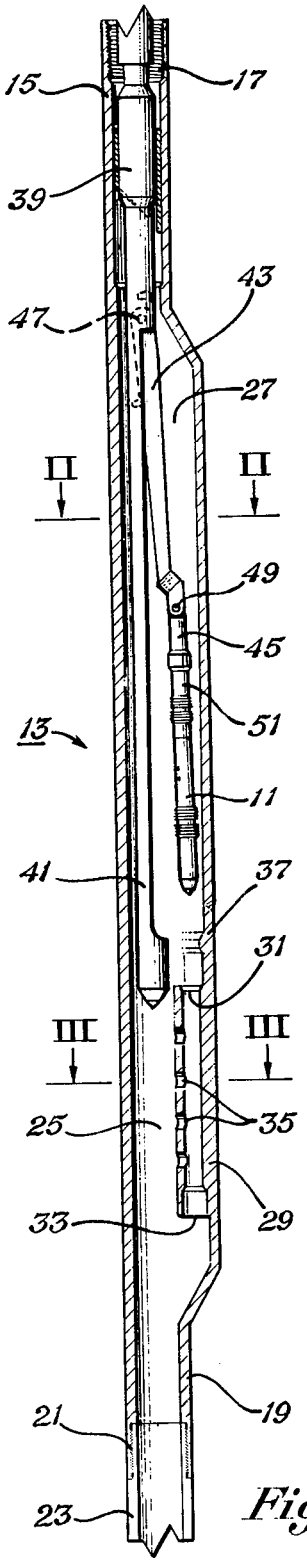
FIG. 1 is a sectional view of a side pocket mandrel and a kickover tool installing or removing a coupon carrier.

FIG. 1 of the drawings illustrates a coupon carrier 11 being inserted into or being removed from a well tubing mandrel 13. At the upper end, the mandrel 13 has a cylindrical portion 15 with threads 17, and at the lower end, the mandrel 13 has another cylindrical section 19, this section also having threads 21. These threads 17, 21 constitute connection means for connecting the mandrel within well tubing 23 downhole.

Between the two cylindrical portions 15, 19, the mandrel 13 has a main bore 25 which is generally the same size as , and aligned with, the cylindrical portions 15, 19 and the well tubing 23. The mandrel 13 also has a side pocket 27, whose axis is offset from the main bore 25 and which includes a valve seat 29 for receiving the coupon carrier 11. The valve seat 29 is so named because it was originally designed to hold flow valves or other types of instruments.

The side pocket 27 extends through the valve seat 29 through a passage 31 at the upper end of the valve seat 29 and a passage 33 at the lower end of the valve seat 29. A number of other passages 35 extend through the valve seat 29 between the side pocket 27 and the main bore 25. Near the upper end of the valve seat 29, a latch retainer 37 is formed by a reduction in the internal diameter of the side pocket 27. This latch retainer 37 constitutes latch means for releasably retaining the carrier 11 in the side pocket 27. The coupon carrier 11 is inserted and removed by a kickover tool 39 of a type well known in the art. The kickover tool 39 includes a guide case 41, a shifting tool 43, and a carrier handling support 45. The shifting tool 43 is pivotally attached to the guide case 41 at pin 47 and the carrier handling support 45 is pivotally attached to the shifting tool at pin 49. The carrier handling support 45 is detachably connected to a latch assembly 51 which is in turn secured to the coupon carrier 11.

Figure 2:
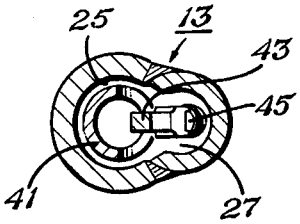
FIG. 2 is a sectional view of a side pocket mandrel as seen along lines II—II of FIG. 1.

FIG. 2 of the drawings is a sectional view as seen along lines II—II of FIG. 1. The guide case 41 is located in the main bore 25 of the mandrel 13, while the shifting tool 43 has moved the carrier handling support 45 over into the side pocket 27.

Figure 3:
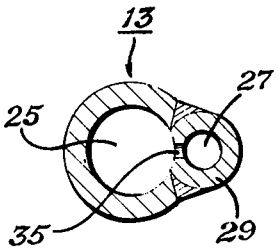
FIG. 3 is a sectional view of a side pocket mandrel as seen along lines III—III of FIG. 1.

FIG. 3 is a sectional view as seen along lines III—III of FIG. 1. The side pocket 27 is offset from the main bore 25 and extends through the valve seat 29. Passages 35 extend between the side pocket 27 and the main bore 25.

Figure 4:
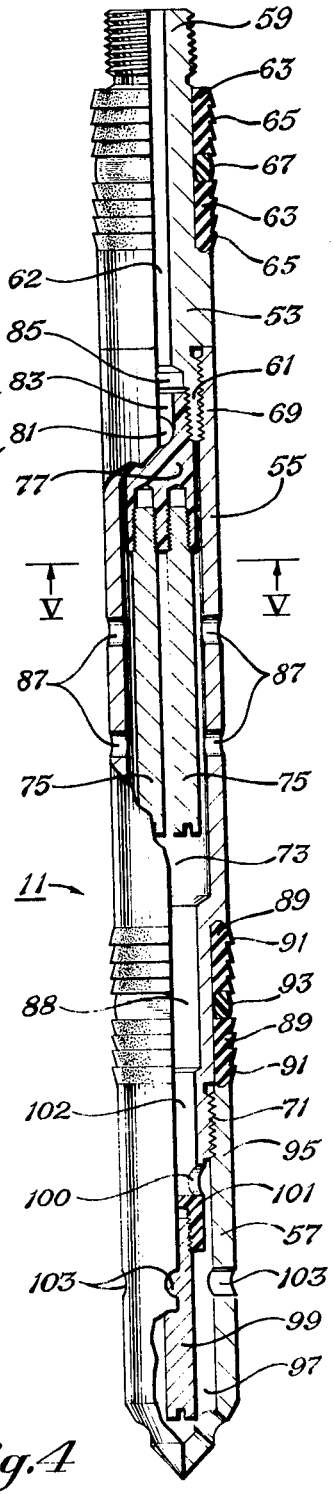
FIG. 4 is a side view, partially in section, of a coupon carrier.

FIG. 4 of the drawings is a more detailed illustration of a coupon carrier 11. The basic metal components of the carrier 11 are the packing mandrel 53, the housing 55, and the nose piece 57. The packing mandrel 53 has external threads 59 on the upper end for connection to the latch assembly 51 (shown in FIGS. 1 and 6), and external threads 61 on the lower end for connection to the housing 55. A bore 62 runs axially through the center of the packing mandrel 53. This bore 62 communicates with the side pocket 27 through another bore (not shown) through the latch assembly 51 (shown in FIGS. 1 and 6). Two sections of asbestos fiber and neoprene packing 63 surround the upper end of the packing mandrel 53 just below the threads 59. Ridges 65 on the outer circumference of the two packing section 63 are oriented in opposite directions. A "Teflon" follower 67 is positioned around the packing mandrel 53 between the sections of packing 63.

The housing 55 of the coupon carrier 11 has internal threads 69 at the upper end for connection to the packing mandrel 53, and external threads 71 at the lower end for connection to the nose piece 57. The housing 55 contains an upper chamber 73 in which a pair of corrosion monitoring coupons 75 are housed. These coupons 75 are elongated strips of carbon steel and are threaded into a plastic upper coupon holder 77.

Figure 5:
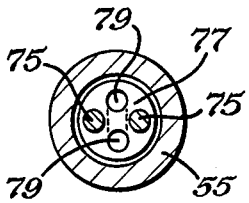
FIG. 5 is a sectional view of a coupon holder as seen along lines V—V of FIG. 4.

The upper coupon holder 77 is in turn threaded into the bottom of the packing mandrel 53. Two vertical ducts 79 pass through the upper coupon holder 77, from the chamber 73 to a horizontal duct 81 in the coupon holder 77. These vertical ducts 79 can be seen in FIG. 5. The horizontal duct 81 leads to a single vertical duct 83, which in turn leads to a small chamber 85 between the upper coupon holder 77 and the packing mandrel 53. This chamber 85 communicates with the bore 62 in the packing mandrel 53.

There are several ports 87 in the housing 55, creating port means for allowing fluid to enter the chamber 73 and communicate with the coupons 75. A bore 88 runs axially through the lower part of the housing 55. Two sections of packing 89 surround the lower end of the housing 55 just above the threads 71. Ridges 91 on the outer circumference of the two packing sections 89 are oriented in opposite directions. A Teflon follower 93 is positioned around the housing 55 between the sections of packing 89.

The nose piece 57 has internal threads 95 for connection to the lower end of the housing 55. The nose piece 57 contains a lower chamber 97 in which a single coupon 99 is mounted. The coupon 99 is threaded into a lower coupon holder 101, which is in turn threaded into the bottom of the housing 55. A horizontal duct 100 and a vertical duct 102 in the lower coupon holder 101 create a passage between the lower chamber 97 and the bore 88 of the housing 55. Ports 103 in the nose piece 57 are the port means for allowing fluid to enter the lower chamber 97 and to communicate with the coupon 99.

Figure 6:
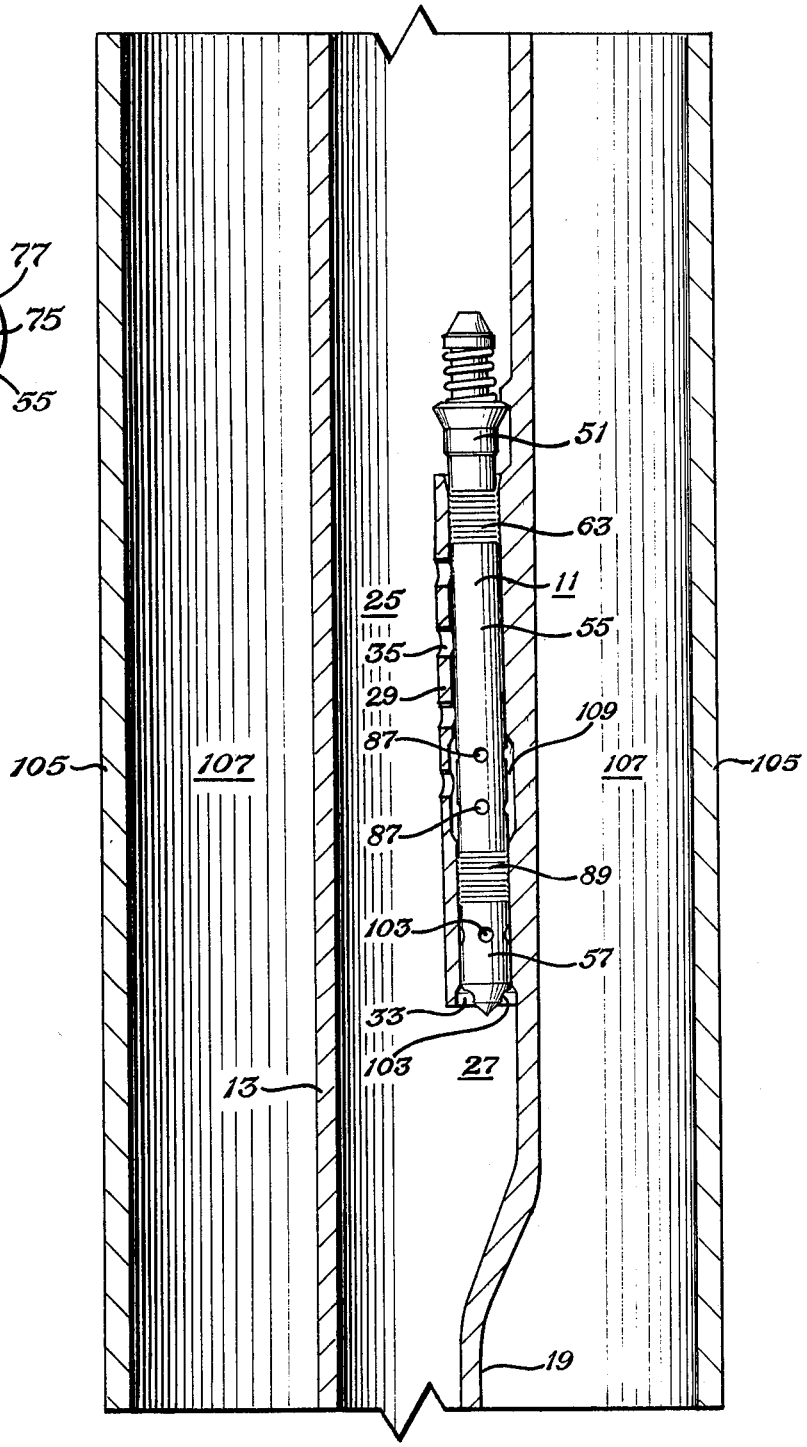
FIG. 6 is a sectional view of a side pocket mandrel, with a coupon carrier placed in the side pocket.

FIG. 6 illustrates a coupon carrier 11 placed in the valve seat 29 of a side pocket 27. The well tubing mandrel 13 is surrounded by well casing 105 defining an annulus 107 between the mandrel 13 and the casing 105. It can be seen how the side pocket 27 is offset so that the main bore 25 is aligned with and generally the same size as the cylindrical portions 15, 19 and the well tubing 23 (shown in FIG. 1).

The sections of packing 63, 89 seal off an interior section 109 of the side pocket 27. This section 109 communicates wtih the main bore 25 through the passages 35 through the valve seat 29. Tubing fluid from the main bore 25 can also flow through the lower passage 33 of the valve seat 29 and the through the ports 103 in the nose piece 57 of the carrier 11 into the lower chamber 97 (shown in FIG. 4).

In operation, the well tubing mandrel 13 is installed in a string of well tubing 23, so that when the well tubing 23 is in place downhole the mandrel 13 will be at the depth at which it is desired to monitor the tubing fluid. Coupons 75, 99 are then inserted into a coupon carrier 11. The plastic holders 77, 101 act as insulators between the coupons 75, 99 and the carrier 11.

The carrier is connected to a latch assembly 51 which is then attached to the carrier handling support 45 of a standard kickover tool 39. The kickover tool 39 is then run down the tubing 23 until it reaches the side pocket mandrel 13. The kickover tool 39 is then maneuvered so that the shifting tool 43 moves the carrier 11 over into the side pocket 27. The carrier 11 is then placed into the valve seat 29 of the side pocket 27. The latch assembly 51 latches under the latch retainer 37. The carrier handling support 45 releases the latch assembly 51 and the kickover tool 39 is removed from the well. At this point the carrier is in the position illustrated in FIG. 6.

Tubing fluid from the main bore 25 can enter or leave the coupon carrier 11 in any of three ways. First, fluid may flow through the latch assembly 51, the packing mandrel 53, and the upper coupon holder 77 into the upper chamber 73. Secondly, fluid may enter or leave the upper chamber 73 through the ports 87 in the housing 55 and the passages 35 in the valve seat 29. Lastly, fluid may enter or leave the lower chamber 97 through the ports 103 in the nose piece 57 and the passage 33 at the bottom of the valve seat 29. Fluid in the lower chamber 97 communicates with fluid in the upper chamber 73 through the ducts 100, 102 and in the coupon holder 101 and the bore 88 of the housing 55.

The sections of packing 63, 89 seal between the carrier 11 and the valve seat 29 and force the fluid to flow through the carrier 11 rather than between the carrier 11 and the valve seat 29. As the fluid circulates through the carrier 11, the fluid communicates with the coupons 75, 99 and has a corrosive effect on the coupons 75, 99 similar to the corrosive effect of the fluid on the tubing 23. It is important that the fluid flow past the coupons 75, 99 in order to produce accurate results, since stagnant fluid will not corrode at the same rate as flowing fluid.

After the carrier has been in the well a specified time, the carrier is removed. The kickover tool 39 is again run down the tubing 23 until it reaches the side pocket mandrel 13. Then the tool 39 is maneuvered so that the shifting tool 43 positions the carrier handling support 45 onto the latch assembly 51. The kickover tool 39 is then raised, releasing the latch assembly 51 from the latch retainer 39 and removing the carrier 11 from the well.

The carrier 11 is then disassembled and the coupons 75, 99 are inspected for corrosion. The corrosive effect of the fluids on the coupons 75, 99 should be somewhat analogous to the corrosive effects on the tubing 23.

While the invention has been described in only one of its forms, it should be apparent to those skilled in the art that it is not so limited, but is susceptible to various changes and modifications without departing from the spirit thereof.

I claim:

1. A method of monitoring fluid within well tubing, comprising the steps of:

installing a well tubing mandrel downhole in well tubing, said mandrel having a main bore, a side pocket offset from the main bore, and a passage between the main bore and the side pocket, the exterior surface of the mandrel being free of apertures;

mounting a coupon in a carrier, said coupon being a rod of selected material;

placing the carrier into the side pocket, with the coupon in communication with the passage, for a specified time period.

removing the carrier from the well tubing; and inspecting the coupon.

2. A side pocket mandrel for supporting a fluid monitoring device in well tubing, comprising;

an upper and a lower cylindrical section for connection within the well tubing;

an intermediate section having a main bore, a side pocket offset from the main bore, and a passage between the main bore and the side pocket, the exterior surface of the intermediate section being free of apertures; and latch means for releasably retaining the fluid monitoring device in the side pocket.

3. An apparatus for monitoring fluids in a well, comprising:

a well tubing mandrel having connection means for connecting the mandrel within well tubing downhole, a main bore, a side pocket offset from the main bore, and a passage between the main bore and the side pocket, the exterior surface of the mandrel being free of apertures;

a cylindrical carrier, mounted in the side pocket, having port means for allowing fluids to communicate with the interior of the carrier; and a coupon secured to the carrier, said coupon being a rod of selected material.

4. A method of monitoring fluid within well tubing comprising the steps of:

installing a well tubing mandrel downhole in well tubing, said mandrel having a main bore, a side pocket offset from the main bore, and a plurality of passages between the main bore and the side pocket, the exterior surface of the mandrel being free of apertures;

mounting a coupon in a carrier, said coupon being a rod of selected material;

placing the carrier into the side pocket, with the coupon in communication with the passages, for a specified time period;

removing the carrier from the well tubing; and inspecting the coupon.

5. A side pocket mandrel for supporting a fluid monitoring device in well tubing, comprising:

an upper and a lower cylindrical section for connection within the well tubing;

an intermediate section having a main bore, a side pocket offset from the main bore, and a plurality of passages between the main bore and the side pocket, and exterior surfaces of the intermediate section being free of apertures; and latch means for releasably retaining the fluid monitoring device in the side pocket.

6. An apparatus for monitoring fluids in a well, comprising:

a well tubing mandrel having connection means for connecting the mandrel within well tubing downhole, a main bore, a side pocket offset from the main bore, and a plurality of passages between the main bore and the side pocket, the exterior surface of the mandrel being free of apertures;

a cylindrical carrier, mounted in the side pocket, having port means for allowing fluids to communicate with the interior of the carrier; and a coupon secured to the carrier, said coupon being a rod of selected material.

* * * * *